United States Patent [19]

Coburn

[11] Patent Number: 4,730,393

[45] Date of Patent: Mar. 15, 1988

[54] LOCKING KNIFE WITH MOVABLE SCALE

[75] Inventor: Ronald Coburn, Bradford, Pa.

[73] Assignee: W.R. Case & Sons Cutlery Co., Bradford, Pa.

[21] Appl. No.: 820,760

[22] Filed: Jan. 17, 1986

[51] Int. Cl.[4] ..... B26B 1/10

[52] U.S. Cl. ..... 30/153; 30/155

[58] Field of Search ..... 30/153, 154, 155, 158, 30/159

[56] References Cited

U.S. PATENT DOCUMENTS

| | | | |
|---|---|---|---|
| 337,858 | 3/1886 | Neuhaus | 30/153 |
| 357,353 | 2/1887 | Wiesner | 30/153 X |
| 1,270,727 | 6/1918 | Hanstein | 30/153 |
| 1,428,296 | 9/1922 | Neft | 30/153 |

FOREIGN PATENT DOCUMENTS

| | | | |
|---|---|---|---|
| 38461 | 2/1928 | Denmark | 30/153 |
| 29749 | 12/1884 | Fed. Rep. of Germany | 30/153 |

*Primary Examiner*—E. R. Kazenske
*Assistant Examiner*—Michael D. Folkerts
*Attorney, Agent, or Firm*—Pennie & Edmonds

[57] ABSTRACT

A folding knife having a blade, a first scale and a second scale on either side of the blade with a tumbler or back spring positioned to hold the blade in its operative position having the features of pivotal mounting of the second scale and hand-force latching means of the second scale whereby the second scale can be readily pivotally moved away from the first scale for cleaning.

5 Claims, 6 Drawing Figures

LOCKING KNIFE WITH MOVABLE SCALE

BACKGROUND OF THE INVENTION

Folding or pocket knives include blades, scales and further arrangements for pivoting and housing the blades. Knives used for filleting, cutting and cleaning fish or other food substances require periodic thorough cleaning.

The construction, assembly, orientation of parts or disassembly of prior knives has not afforded desired simplicity and ease of operation while at the same time permitting required cleaning.

SUMMARY OF THE INVENTION

Broadly, the present invention comprises a folding knife having a blade, a first scale and a second scale on either side of the blade with a tumbler or back spring positioned to hold the blade in its operative position having the features of pivotal mounting of the second scale and hand-force latching means of the second scale whereby the second scale can be readily pivotally moved away from the first scale for cleaning.

It is a feature of the knife that the second scale latch arrangement includes a slot with ramp means for engaging and disengaging a headed pin positioned on the first scale.

DESCRIPTION OF THE PREFERRED EMBODIMENT

Figure 2:
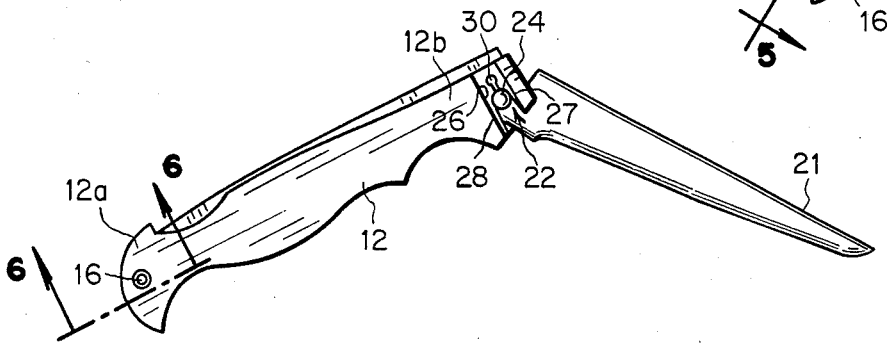
FIG. 2 is a right side elevational view (with handle panels removed) of the knife is in a partially closed position.
Figure 4:
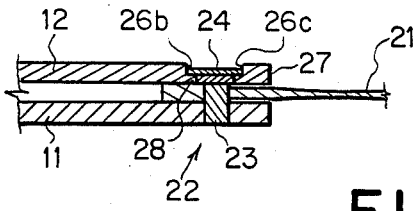
FIG. 4 is a partial sectional view taken along line 4—4 of FIG. 1.
Figure 5:
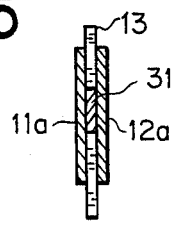
FIG. 5 is a sectional view taken along line 5—5 of FIG. 1.
Figure 6:
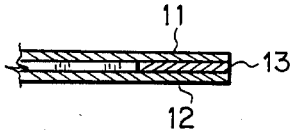
FIG. 6 is a partial sectional view taken along line 6—6 of FIG. 2.

Turning to the Figures, locking knife 10 includes first scale or plate 11 having rearward portion 11*a* and front blade-end portion 11*b*, second scale or plate 12 (see FIG. 2) having rearward portion 12*a* and front blade-end portion 12*b*, and spacer piece 13 (see FIGS. 4 and 5) between the scales rearward portions 11*a*, 12*a*, all such parts secured together about pivot pin 16. Spacer piece 13 is immovably secured to first scale 11 while second scale 12 is mounted about pin 16 for rotation as further described to permit cleaning of the knife 10.

Mounted on the first scale 11 about pivot pin 17 is back spring 18 and also mounted on first scale 11 is knife blade 21. First scale 11 carries headed pin arrangement 22 to provide for rotary mounting of knife blade 21 and as a locking means. Headed pin arrangement 22 includes stem 23 and enlarged head 24 with stem 23 permanently secured to (or formed as part of) scale 11.

Head pin arrangement 22 is normally located in slot 26 in the front blade-end 12*b* of scale 12. Slot 26 includes border ramp pieces 27, 28 which receive enlarged head 24 when it is moved into slot 26 to accomplish a friction fit between the ramp pieces 27, 28 and the underside of head 24. Once head 24 rides up, along and past ramp pieces 27, 28, which extend along only a part of slot 26, it passes a neck portion 26*a* of slot 26 to a wider portion of slot 26 where it is held in place to remain until a reverse force urges enlarged head 24 back over the ramp pieces 27, 28 and past neck portion 26*a*. Slot 26 also has a keyhole opening 30 at one end to afford some resilience in slot walls 26*b*, 26*c*, so they can be moved apart under the force as applied by movement of enlarged head 24. In the operable position of the folding knife, scales 11, 12 are generally parallel and superimposed as viewed in FIG. 1. In this operable position back spring 18 holds blade 21 in a fixed rigid position.

When the blade is not in use, it may be released by depressing the back spring 18 to tilt against spring 31 (FIG. 3) about pin 17 and release blade 21 for rotation to its closed position.

Figure 1:
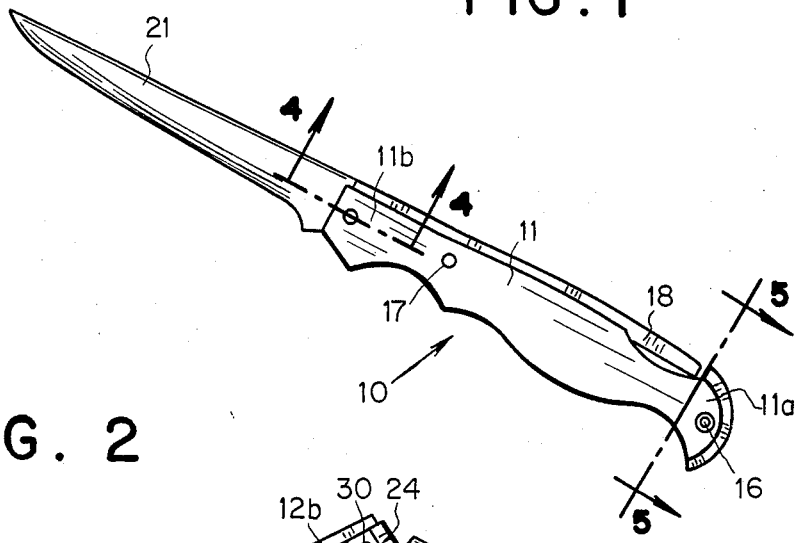
FIG. 1 is a left side elevational view (with handle panels removed) of the locking knife in its blade-open operable position.
Figure 3:
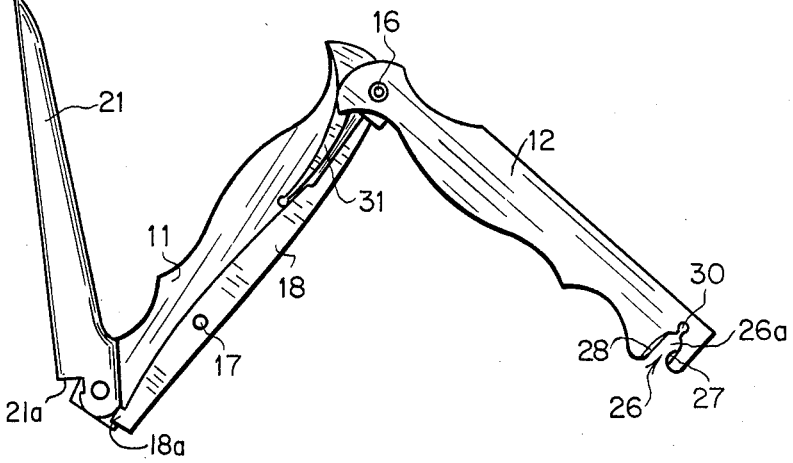
FIG. 3 is a side elevational view with one scale pivoted to an angle to the other scale for cleaning.

Turning now to FIG. 3, second scale 12 is shown rotated to an angle to first scale 11 by urging the scale apart (as they rotate about headed pin 16). Second scale slot 26 is readily movable past enlarged head 24 by application of sufficient hand force. Blade 21 has locking notch 21*a* which locks with back spring projection 18*a* when the blade is in its open position. In the knife position shown in FIG. 3, knife 10 is easily cleaned to remove fish, meat and other materials which lodge in the knife during use. After cleaning has been completed, second scale 12 is rotated back to its normal position (FIG. 1).

Preferably each scale may have mounted on it, using glue or other suitable means, a handle panel (not shown) of plastic, bone or other material for functional and decorative purposes.

What is claimed is:

1. A folding knife comprising a blade which is movable from a closed position to an operable open position, a first scale in the form of an elongated plate having a blade-end portion and a back end portion position on one side only of the blade and a second scale also in the form of an elongated plate positioned only on the other side of the blade, the first scale plate and second scale plate lying in spaced-apart parallel planes, which scale plates are spaced apart a distance to accommodate between them a back spring-biased element pivotally mounted on the first scale, the blade pivotally mounted on the first scale and the second scale pivotally mounted on the back end of the first scale for pivotal movement to a selected angle with the first scale for cleaning or for movement to a closed position for operation, the first and second scale plates as spaced-apart permitting the blade to be pivotally moved to its closed position or to its operative open position when the scale plates are in their closed position.

2. The folding knife of claim 1 in which the blade-end portion of second scale includes slot means and the first scale includes projection means thereon for engagement in such slot means when the second scale carrying the slot means is pivoted about the first scale.

3. The folding knife of claim 2 in which the slot projection engaging means is a positive snap lock fit of slot means over a head pin arrangement.

4. The folding knife of claim 2 in which the slot means includes a neck opening past which the slot projection means moves to accomplish engagement of the scales.

5. The knife of claim 1 in which the knife is a locking knife.

* * * * *